US006572348B2

(12) United States Patent
Sakurai et al.

(10) Patent No.: US 6,572,348 B2
(45) Date of Patent: Jun. 3, 2003

(54) ELECTROMAGNETIC COMPRESSOR HAVING AN INTEGRAL CYLINDER ASSEMBLY AND ELECTROMAGNET MOLDED FROM A RESIN

(75) Inventors: Hiroto Sakurai, Tokyo (JP); Masanori Nishikiori, Tokyo (JP); Haruki Nakao, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 0 days.

(21) Appl. No.: 10/141,838

(22) Filed: May 9, 2002

(65) Prior Publication Data

US 2002/0136650 A1 Sep. 26, 2002

Related U.S. Application Data

(63) Continuation of application No. PCT/JP01/07839, filed on Sep. 10, 2001.

(30) Foreign Application Priority Data

Sep. 11, 2000 (JP) ..... 2000-275456
Jul. 6, 2001 (JP) ..... 2000-206839

(51) Int. Cl.[7] ..... F04B 17/00

(52) U.S. Cl. ..... 417/415; 417/410.1; 417/488; 417/547

(58) Field of Search ..... 417/415, 410.1, 417/486, 487, 488, 546, 547

(56) References Cited

U.S. PATENT DOCUMENTS 3,302,582 A * 2/1967 Kofink ..... 417/547
4,090,816 A 5/1978 Takahashi ..... 417/371
4,547,757 A * 10/1985 Yamada ..... 335/296
4,925,155 A * 5/1990 Carman ..... 251/117
5,518,372 A * 5/1996 Chin ..... 417/415
5,818,131 A * 10/1998 Zhang ..... 310/15
6,326,706 B1 * 12/2001 Zhang ..... 310/12

FOREIGN PATENT DOCUMENTS

JP 47-33308 A 11/1972 ..... 417/415
JP 06042464 A * 2/1994 ..... 417/415
JP 6-45666 11/1994 ..... 417/517

* cited by examiner

*Primary Examiner*—Cheryl J. Tyler
(74) *Attorney, Agent, or Firm*—Pennie & Edmonds LLP

(57) ABSTRACT

An electromagnetic compressor capable of reciprocating a piston to suck in and compress a gas by the force of an electromagnet and the resilient force of a return spring and a manufacturing method therefor are provided. The compressor includes a cylinder assembly including a front cylinder portion, a rear cylinder portion, and a center hole capable of storing the piston for reciprocation and having a working chamber defined by means of the piston, and an electromagnet located between the front cylinder portion and the rear cylinder portion and capable of actuating the piston. The cylinder assembly and the electromagnet have an integral structure molded from a resin in a manner such that the internal passage is hermetically sealed with respect to the electromagnet and the electrically conductive member.

10 Claims, 13 Drawing Sheets

ELECTROMAGNETIC COMPRESSOR HAVING AN INTEGRAL CYLINDER ASSEMBLY AND ELECTROMAGNET MOLDED FROM A RESIN

CROSS-REFERENCE TO RELATED APPLICATIONS

This is a Continuation Application of PCT Application No. PCT/JP01/07839, filed Sep. 10, 2001, which was not published under PCT Article 21 (2) in English.

This application is based upon and claims the benefit of priority from the prior Japanese Patent Applications No. 2000-275456, filed Sep. 11, 2000; and No. 2001-206839, filed Jul. 6, 2001, the entire contents of both of which are incorporated herein by reference.

BACKGROUND OF THE INVENTION

1. Field of the Invention

The present invention relates to an electromagnetic compressor and a manufacturing method therefor, and more particularly, to an electromagnetic compressor suitably used to suck in and compress a combustible gas, such as town gas, or some other gas and a manufacturing method therefor.

2. Description of the Related Art

Conventionally, electromagnetic compressors that compress and discharge fluids such as air have widely been used, and various inventions related to the electromagnetic compressors have been made. A typical example of an electromagnetic compressor of this type is described in Jpn. Pat. Appln. KOKOKU Publication No. 57-30984, which will be described in brief with reference to FIG. 13.

An electromagnetic compressor 200 has a structure such that a front frame 202 and a front cover 203 are arranged successively in front (see the left-hand side of the drawing) of a stationary electromagnetic circuit 201, while a rear frame 204 and a rear cover 205 are arranged successively in the rear (see the right-hand side of the drawing). These elements are coupled together to form the body shell of the electromagnetic compressor 200.

The front frame 202 has a front collar 206 and a rear collar 207. The front collar 206 is formed integrally having a front fitting cylinder portion 208 and a rear fitting cylinder portion 209 that are aligned with each other. A front cylinder 210 is fitted in the front fitting cylinder portion 208, a rear cylinder 211 is fitted in the rear fitting cylinder portion 209, and the front frame 202 and the rear cylinder 211 are fixed together by means of a plurality of screws 212.

The rear frame 204 has a front collar 213 and an outer collar 214. The rear collar 207 of the front frame 202 and the front collar 213 of the rear frame 204 are screwed together to the stationary electromagnetic circuit 201. Thus, the respective opposite faces of the rear collar 207 and the front collar 213 abut against the front and rear faces, respectively, of the stationary electromagnetic circuit 201.

The stationary electromagnetic circuit 201 is wound with a coil 215. North or south magnetic poles that are formed as the coil 215 is energized are located in longitudinal notches of the rear fitting cylinder portion 209. A magnetic armature 220 that is electromagnetically attracted to the magnetic poles is held between a front piston 222, which has a piston head 221 slidable in the front cylinder 210, and a rear piston 223 slidable in the rear cylinder 211. These three elements are fixed together by means of a screw 224. A return spring 226 is interposed between the rear piston 223 and a cap 225 of the rear cylinder 211.

If the stationary electromagnetic circuit 201 is excited in the compressor constructed in this manner, the magnetic armature 220, which is integral with the front and rear pistons 222 and 223 (hereinafter referred to simply as the piston 222), is advanced by electromagnetic attraction as illustrated, resisting the resilient force of the return spring 226. If the excitation is cancelled, on the other hand, the piston 222 returns pressed by the return spring 226. As the piston 222 reciprocates in this manner, air in a working chamber 227 that is fixed in the front cylinder 210 is repeatedly brought to rare and dense states.

Thus, when the piston 222 is retreated by means of the force of electromagnetic attraction, an inlet valve 228 attached to the piston head 221 opens to the working chamber 227. Thereupon, air introduced into the compressor body through inlet ports 230 of the rear cover 205 flows into the working chamber 227 through a filter 231, supply holes 232, 232, and inlet ports 233. When the piston 222 advances pressed by the return spring 226, on the other hand, the air in the working chamber 227 becomes dense. Consequently, a discharge valve that is attached to a part of the wall portion of the working chamber 227 opens, whereupon the compressed air is supplied through discharge ports 234, a tank 235, and a discharge port 236 to an external apparatus that is connected to a hose as required.

If the compressor constructed in this manner is applied to the suction and compression of a combustible gas such as town gas, however, the combustible gas sucked into the working chamber 227 is inevitably guided to the supply holes 232 and the inlet ports 233 via the periphery of electrical parts, e.g., the coil 215 and the like. Since the front and rear faces of the stationary electromagnetic circuit 201, the rear collar 207, and the front collar 213 abut against one another, moreover, there is a possibility of the combustible gas leaking out through the abutting portions.

BRIEF SUMMARY OF THE INVENTION

According to the present invention, there is provided an electromagnetic compressor capable of reciprocating a piston to suck in and compress a gas by means of the force of attraction of an electromagnet and the resilient force of a return spring. The compressor comprises a cylinder assembly including a front cylinder portion, a rear cylinder portion, and a center hole capable of storing the piston for reciprocation and having a working chamber defined by the piston; an electromagnet located between the front cylinder portion and the rear cylinder portion and capable of actuating the piston; an electrically conductive member for supplying electricity to the electromagnet; and an internal passage connecting the working chamber to the outside of the compressor. The cylinder assembly and the electromagnet have an integral structure molded from a resin in a manner such that the internal passage is hermetically sealed with respect to the electromagnet and the electrically conductive member.

According to the present invention, there is further provided an electromagnetic compressor capable of reciprocating a piston to suck in and compress a gas by means of the force of attraction of an electromagnet and the resilient force of a return spring. The compressor comprises a housing assembly having a center hole in which the piston is located and a resin layer molded around an electromagnet forming a pair of magnetic poles on the diametrically opposite sides of the piston; and a cylinder portion stored in the center hole, storing the piston for reciprocation, and having a working chamber defined by means of the piston. The inside diameter of the cylinder portion and the outside diameter of the piston sliding in the cylinder are selectable.

According to the present invention, there is still further provided a manufacturing method for an electromagnetic compressor capable of reciprocating a piston to suck in and compress a gas by means of the force of attraction of an electromagnet and the resilient force of a return spring. The method comprises providing a cavity-side mold having a cavity and a columnar protrusion for centering in the cavity and a movable mold having a gate hole; inserting an iron core wound with coils along the columnar protrusion into the cavity-side mold and positioning the iron core so that magnetic poles formed on the iron core are located in given positions; locating the movable mold on the cavity-side mold; and injecting a thermosetting resin into the molds through the gate hole of the movable mold, thereby molding a housing assembly.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
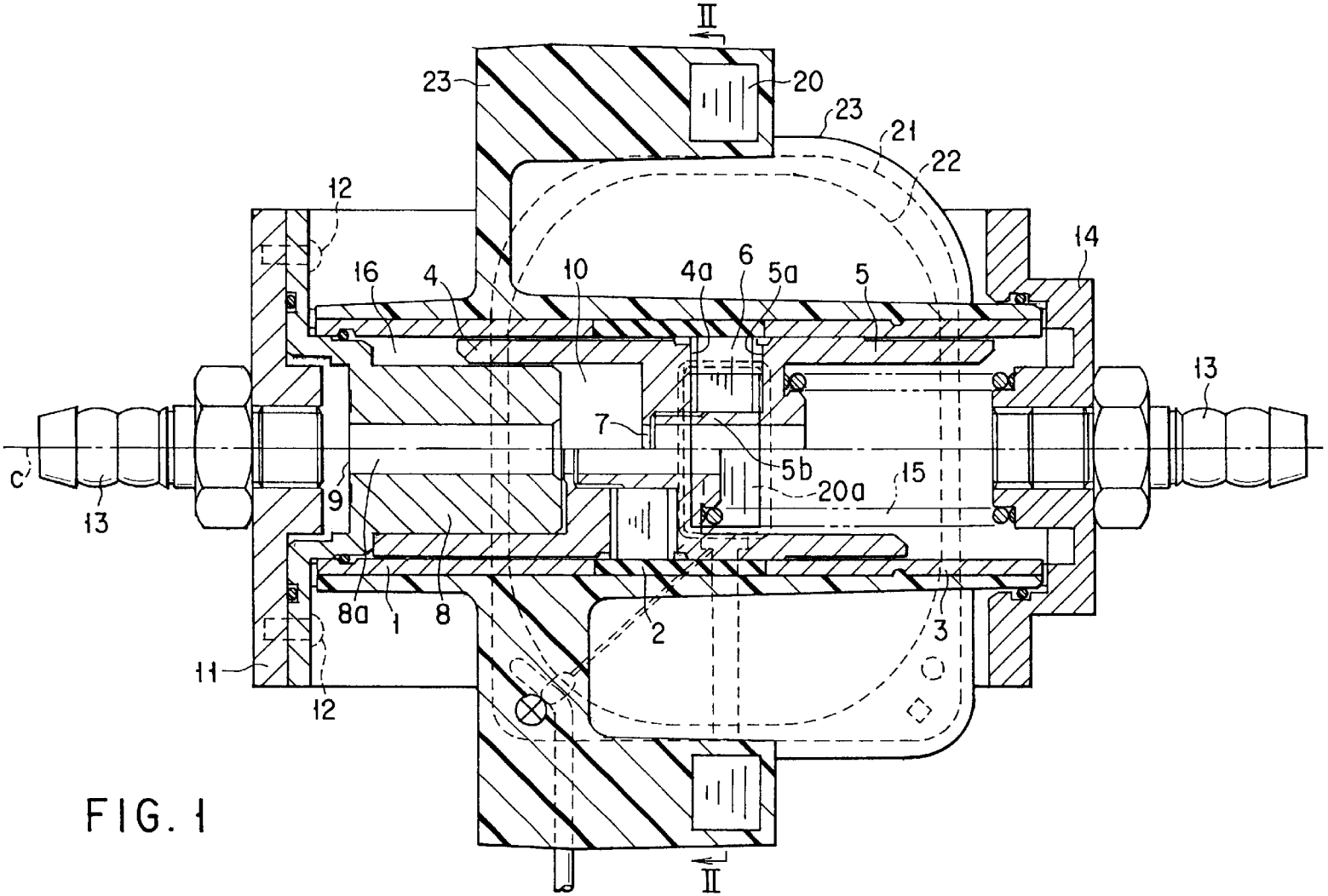
FIG. 1 is a longitudinal sectional view of an electromagnetic compressor according to a first embodiment of the present invention.

The present invention will now be described in detail with reference to the drawings. In the drawings, like numerals refer to like members.

FIG. 1 is a sectional view of one embodiment of an electromagnetic compressor of the present invention, showing a sectional view taken along a plane that passes through its central axis C and extends parallel to the winding plane of a coil wound around an iron core. In this drawing, the upper side above the central axis C shows a position reached when a piston is retreated to the extremity, while the lower side below the central axis C shows a position reached when the piston is advanced to the extremity.

The electromagnetic compressor comprises a cylinder assembly that includes a front cylinder portion 1 in the shape of a cylinder, a spacer 2 formed of an insulating material, and a rear cylinder portion 3, which are coaxial with the central axis C and are arranged successively from the front side (left-hand side of the drawing) to the rear side (right-hand side of the drawing). The front cylinder portion 1, spacer 2, and rear cylinder portion 3 have therein a front piston 4, a magnetic armature 6, and a rear piston 5, which slide along their respective inner surfaces. The front piston 4 has a rear end face 4*a* and a through hole that opens in its central portion. This through hole is penetrated by a part of a small-diameter pipe portion 5*b*, which extends further forward from a front end face 5*a* of the rear piston 5 and is fixed to the front piston 4. The magnetic armature 6 is held between the rear end face 4*a* of the front piston 4 and the front end face 5*a* of the rear piston 5, and is coupled integrally to the front piston 4 and the rear piston 5. An inlet valve 7 is attached to the distal end portion of the small-diameter pipe portion 5*b* of the rear piston 5.

In front of the front piston 4, a head cap 8 is opposed to the front piston 4. An outlet valve 9 is attached to the front end portion of a center hole 8*a* of the head cap 8 that extends in the longitudinal direction. A head cover 11 is provided in front of the outlet valve 9. The head cover 11 is fixed to the head cap 8 by means of screws 12. On the other hand, a return spring 15 is interposed between the rear piston 5 and an end cap 14, which is fitted with a nipple 13. The end cap 14 is fixed to the apparatus body by means of springs (not shown).

Figure 2:
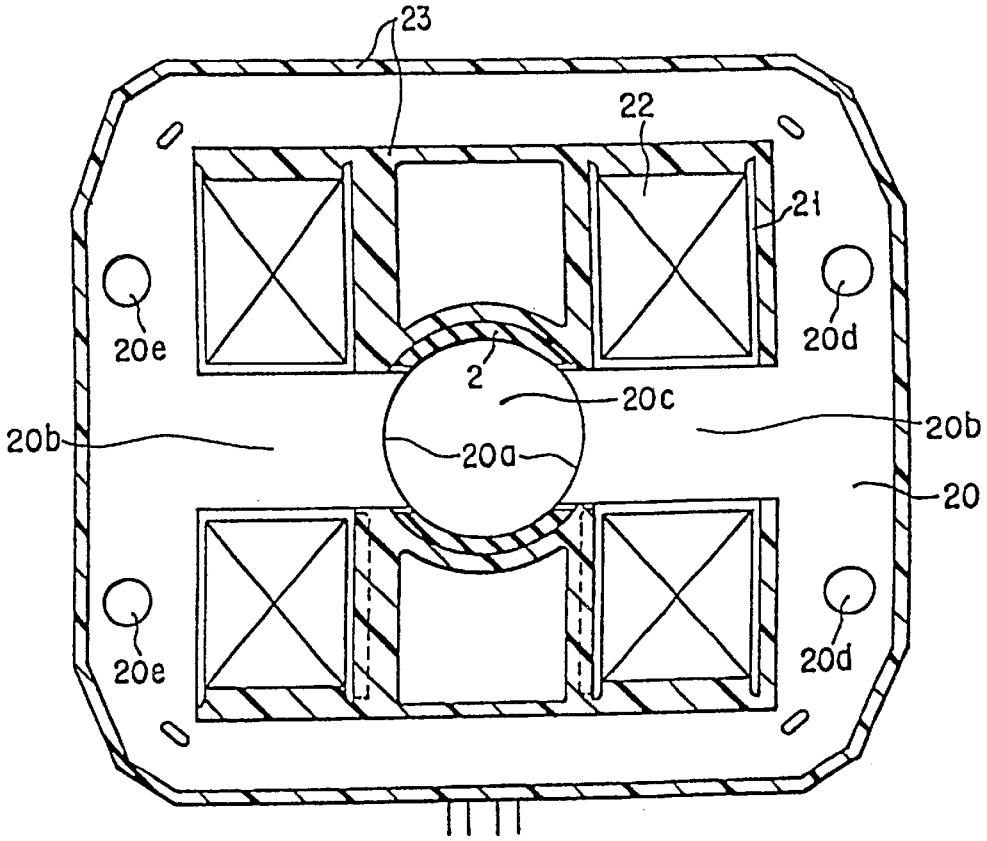
FIG. 2 is a sectional view taken along line II—II of FIG. 1.

FIG. 2 is a view taken along line II—II of FIG. 1. In FIG. 2, the magnetic armature 6 and the rear piston 5 that is located between a pair of magnetic poles 20*a* is not shown.

An electromagnet for electromagnetically attracting the magnetic armature 6 is located in the plane of FIG. 2. Bobbins 21 are fitted individually on arm portions 20*b*, 20*b* of an iron core 20 of the electromagnet, and coils 22 are wound individually therein. When the coils 22 are energized, magnetic poles 20*a*, 20*a* are formed on the respective open ends of the arm portions 20*b*, 20*b*, individually. In this drawing, a resin 23 is molded on the outer periphery of the spacer 2, the inner and outer peripheries of the iron core 20, and the respective outer peripheries of the bobbins 21 and the coils 22.

As shown in FIG. 1, moreover, the cylinder assembly, which includes the front cylinder portion 1, rear cylinder portion 3, and spacer 2, and the iron core 20, bobbins 21, and coils 22, which are located outside the cylinder assembly, are molded in a manner such that their outer peripheral portions are entirely covered with the resin 23. Thus, it can be understood that an outer wall that is formed of the front cylinder portion 1, rear cylinder portion 3, and spacer 2 and defines a gas passage has a sealed structure. Further, the resin 23, along with the spacer 2 and the electromagnet, forms a housing assembly that houses the cylinder portions 1 and 3.

Figure 3A:
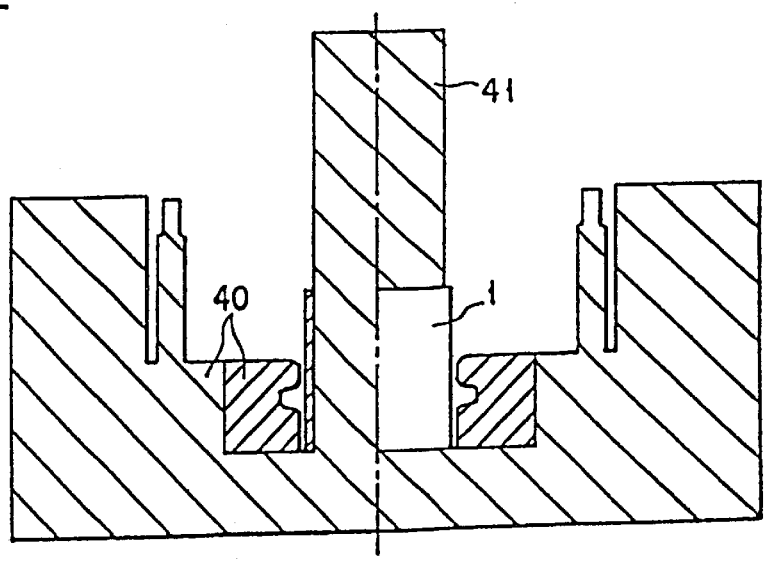
FIGS. 3A to 3E are views illustrating various stages of manufacturing processes for the electromagnetic compressor according to the present embodiment.
Figure 3B:
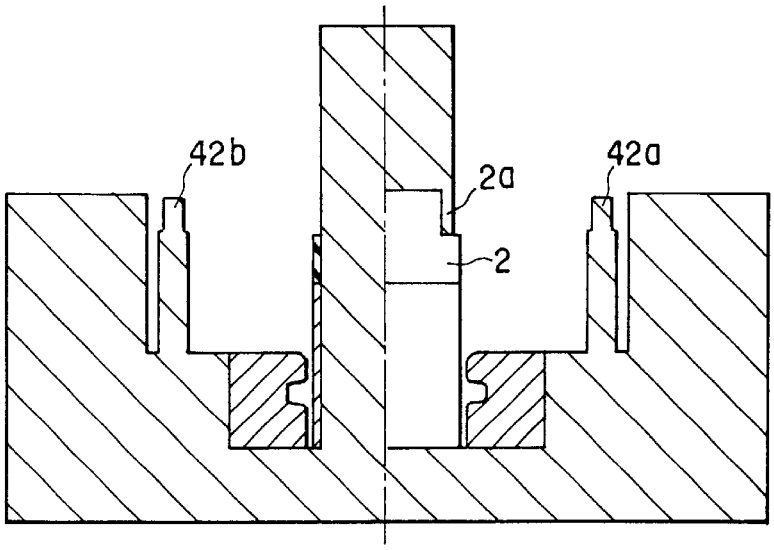
Figure 3C:
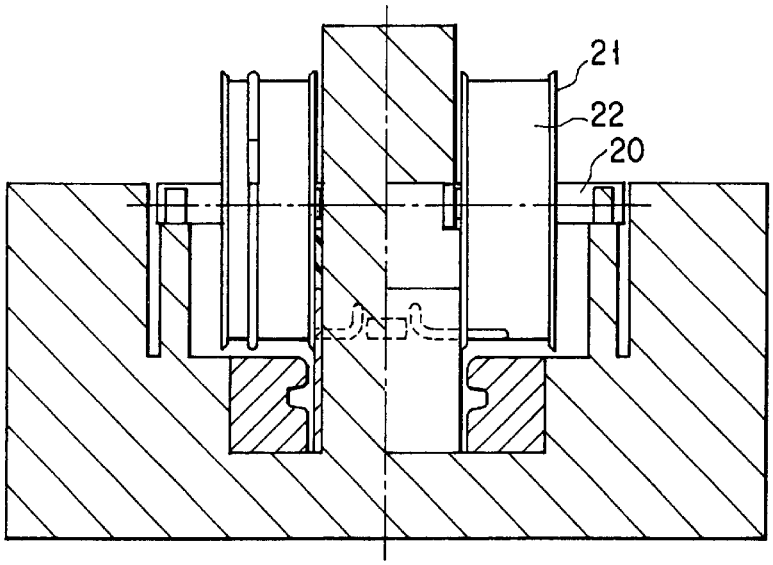

A manufacturing method for the configuration of the principal part of the present embodiment will now be described with reference to FIGS. 3A to 3E. First, a cavity-side mold 40, which includes a cavity and a columnar protrusion 41 for centering located in the center of the cavity, as shown in FIG. 3A, is prepared. The front cylinder portion 1 is inserted along the columnar protrusion 41 of the cavity-side mold 40 into the cavity. Then, the spacer 2 is then inserted along the columnar protrusion 41 into the cavity, as shown in FIG. 3B. The upper part of the spacer 2 is formed having a window 2*a* into which the magnetic poles 20*a* of the iron core 20 are fitted. Then, the iron core 20 that has the bobbins 21 wound individually with the coils 22 is prepared, as shown in FIG. 3C, and is positioned and inserted so that a pole-to-pole gap 20*c* (see FIG. 2) of the iron core 20 fits the columnar protrusion 41 and that holes 20*d* and 20*e* (see FIG. 2) of the iron core 20 fit stepped guide rods 42*a* and 42*b*, respectively. Thereupon, the iron core 20 is put on the spacer 2 so that the magnetic poles 20*a* fit the window 2*a* of the spacer 2. In the case where the spacer 2 is omitted, the iron core 20 can be positioned with respect to the columnar protrusion 41.

Figure 3D:
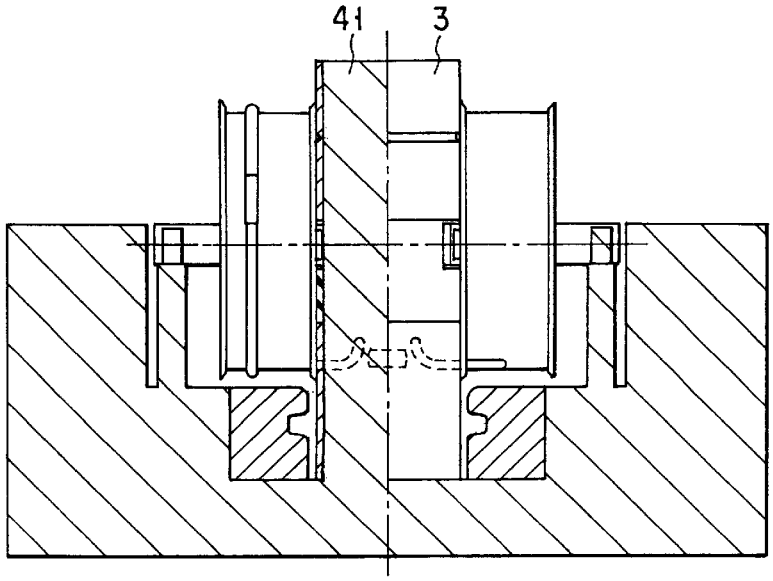
Figure 3E:
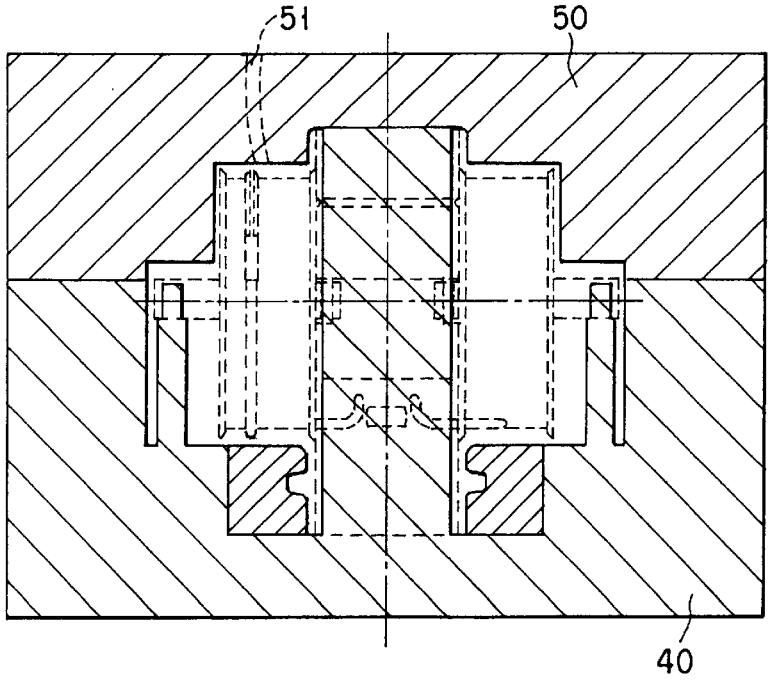

Then, the rear cylinder portion 3 is inserted along the columnar protrusion 41 into the cavity-side mold 40, as shown in FIG. 3D. Finally, a movable mold 50 is put on the cavity-side mold 40 so as to close the cavity, as shown in FIG. 3E. Thereafter, the thermosetting resin 23 is injected into the movable mold 50 through its gate hole 51. If a molded piece is taken out of the molds after the resin 23 is set, the apparatus body can be obtained as a part that is held between the head cap 8 and the end cap 14 shown in FIG. 1 or the whole part except the pistons and the armature.

The operation of the electromagnetic compressor of the present embodiment will now be described with reference to FIG. 1.

A gas such as a combustible gas enters the rear cylinder portion 3 through the nipple 13. If the pistons 4 and 5 move backwards (forwards) due to the force of electromagnetic attraction from the magnetic poles 20*a*, the inlet valve 7 opens, so that the gas is fed into a working chamber 10. When this is done, the outlet valve 9 is closed. Then, the force of electromagnetic attraction is stopped so that the pistons 4 and 5 advance (return) by means of the resilient force of the return spring 15. Thereupon, the inlet valve 7 is closed, so that the gas in the working chamber 10 is compressed. When the pressure of the gas exceeds a given level, the outlet valve 9 is opened, whereupon the gas is discharged through a nipple 13 on the side of the head cover 11. As this is done, an air damper chamber 16 is defined between the head of the front piston 4 and the outer peripheral wall of the head cap 8. Thus, the head of the front piston 4 can be prevented from running against the outer peripheral basal part of the head cap 8 and producing a piston shock during a compression stroke.

According to the present embodiment, the gas, e.g., a combustible gas, passes through the front and rear pistons 4 and 5 only, and never passes through electrical parts such as the coils 22. Thus, the gas can never touch the electrical parts, so that safety can be improved. Unlike the conventional apparatus, moreover, this apparatus has no abutting portions inside and has its gas passage circumferentially entirely sealed with the resin, so that there is no possibility of the gas leaking out of the apparatus.

Figure 4:
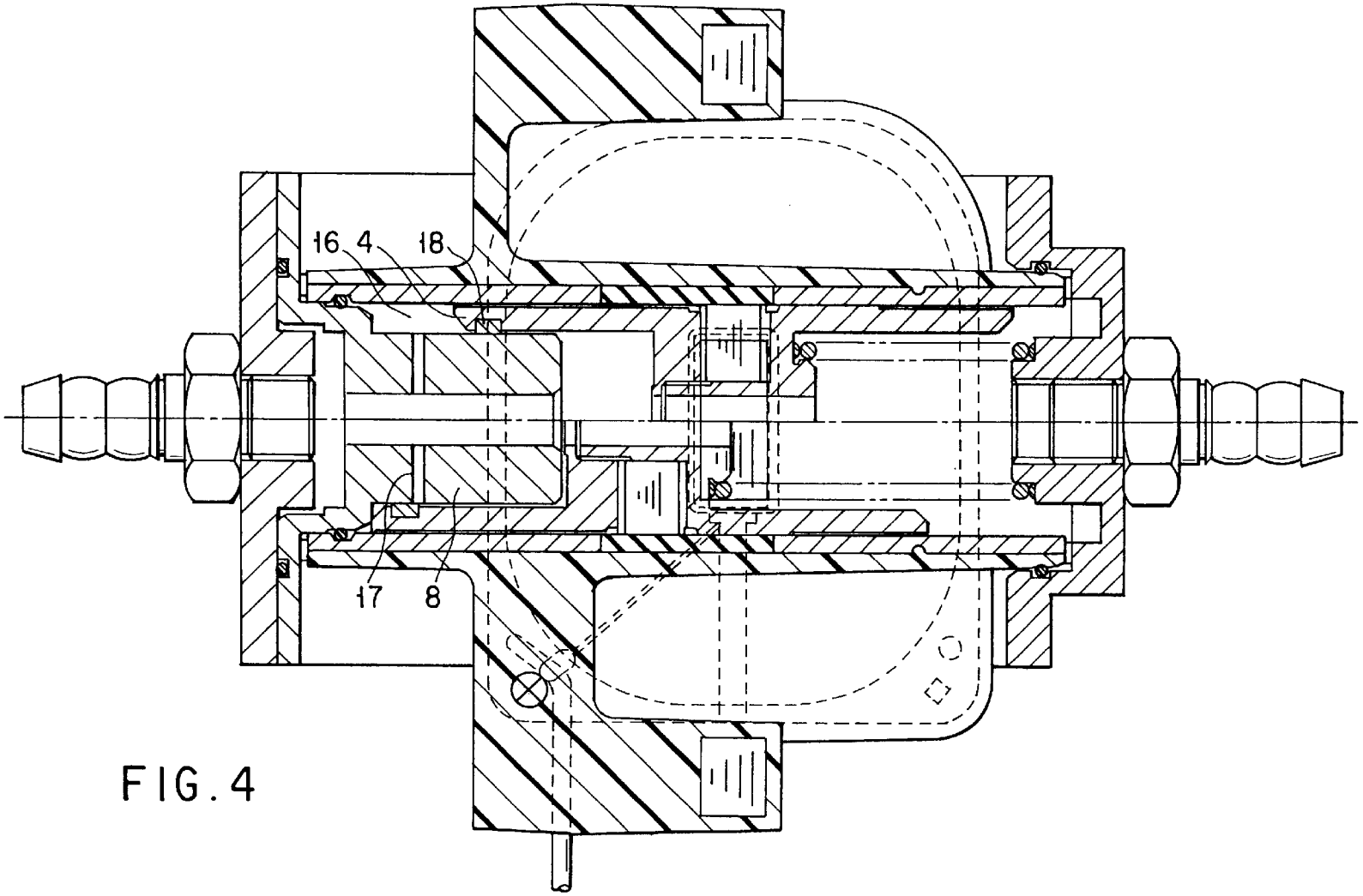
FIG. 4 is a longitudinal sectional view of an electromagnetic compressor according to a second embodiment of the present invention.

A second embodiment of the present invention will now be described with reference to FIG. 4. This embodiment, compared with the first embodiment, is characterized in that a head cap 8 is provided with a radially extending communication hole 17 that connects a compression gas passage and an air damper chamber 16.

According to this embodiment, an inner wall near the head of a front piston 4 is fitted with a piston ring 18 that slides along the outer wall of the head cap 8, and no damper effect can be produced before the head of the front piston 4 reaches the communication hole 17. Thus, an energy loss that is caused during the compression stroke in which the pistons 4 and 5 advance can be minimized.

Figures 5A, 5B:
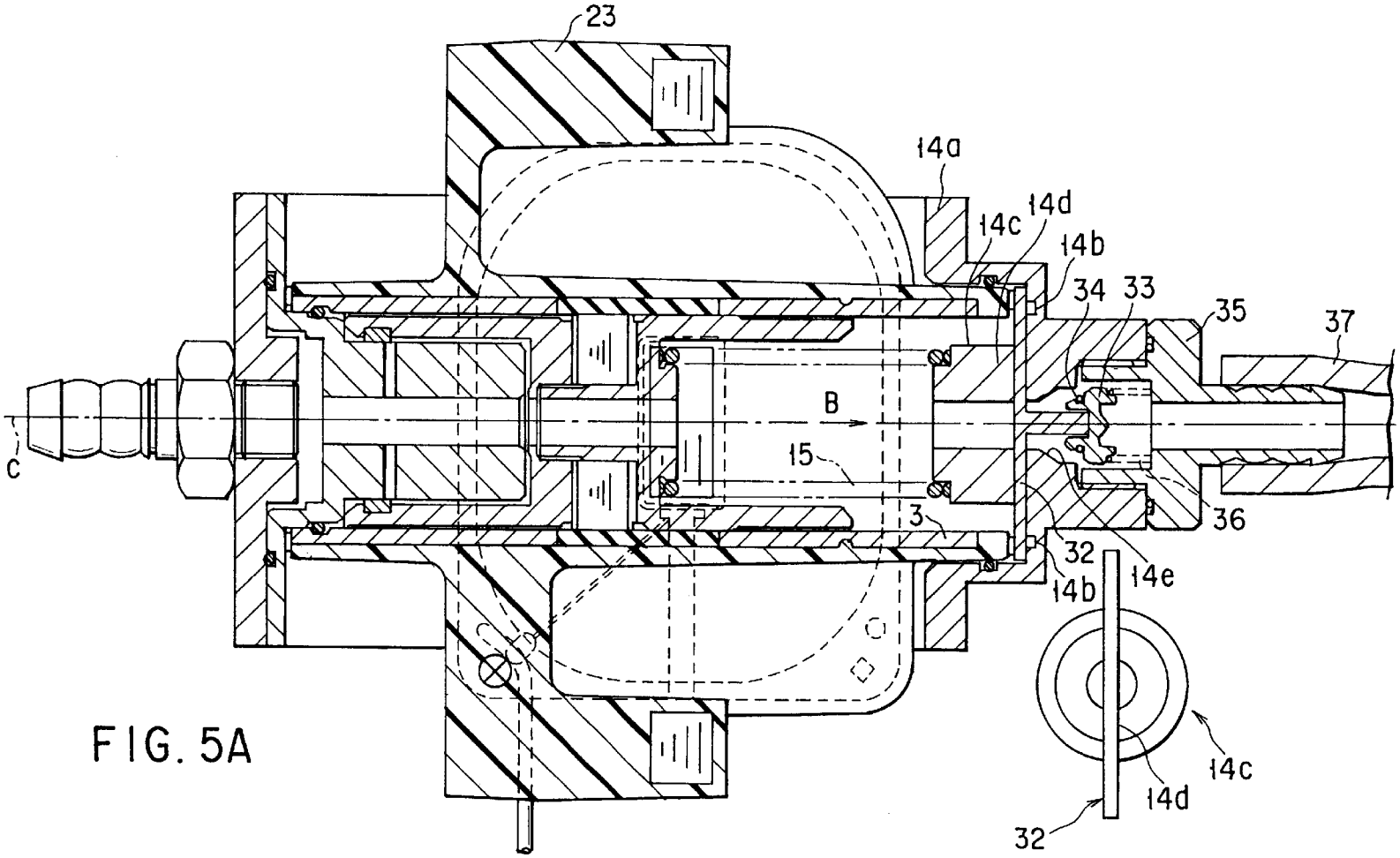
FIG. 5A is a longitudinal sectional view of an electromagnetic compressor according to a third embodiment of the present invention.
FIG. 5B is a view showing the relation between a spring bearing and a stopper of the electromagnetic compressor, taken in the direction of arrow B of FIG. 5A.

A third embodiment of the present invention will now be described with reference to FIGS. 5A and 5B. In this embodiment, an end cap 14*a* having a thin-walled portion 14*b* (fragile portion), preferably ring-shaped, is attached to the rear side or gas-suction side of a rear cylinder portion 3. Further, a T-shaped stopper 32 is located in an expanding slot 14*d* of a spring bearing 14*c* that is integral with the end cap 14*a*. The opposite end portions of the stopper 32 that extend at right angles to a central axis C are supported between the rear end of a resin that covers the outer periphery of the rear cylinder portion 3 and the corner portion of the end cap 14*a*, and an end portion that extends along the central axis C engages a center hole of a valve 33. The valve 33 has an O-ring 34 on its front part, and is fixed to the front end of a spring 36 the rear end of which is supported on a nipple 35. Normally, therefore, the valve 33 is open, pressed against the resilient force of the spring 36 by means of the end portion of the stopper 32 that extends substantially parallel to the central axis C, so that the sucked gas passes through the valve 33.

If the pressure in the rear cylinder portion 3 extraordinarily increases for any reason, however, the thin-walled portion 14*b* of the end cap 14*a* breaks. Accordingly, the part connected with the nipple 35 is pressed by a return spring 15 with the spring bearing 14*c* between them, and is separated from a cylinder assembly. Thereupon, the valve 33 is released from the force of pressure from the stopper 32 and pressed forward by means of the resilient force of the spring 36, whereupon the O-ring 34 abuts hard against a gas passage inner wall 14*e* of the head cover 14*a*. In consequence, the gas sucked in through a hose 37 is cut off by means of the valve 33, whereupon its supply to this electromagnetic compressor stops. Further, the gas is prevented from flowing out through the broken portion of the end cap 14*a*.

Figures 6A, 6B:
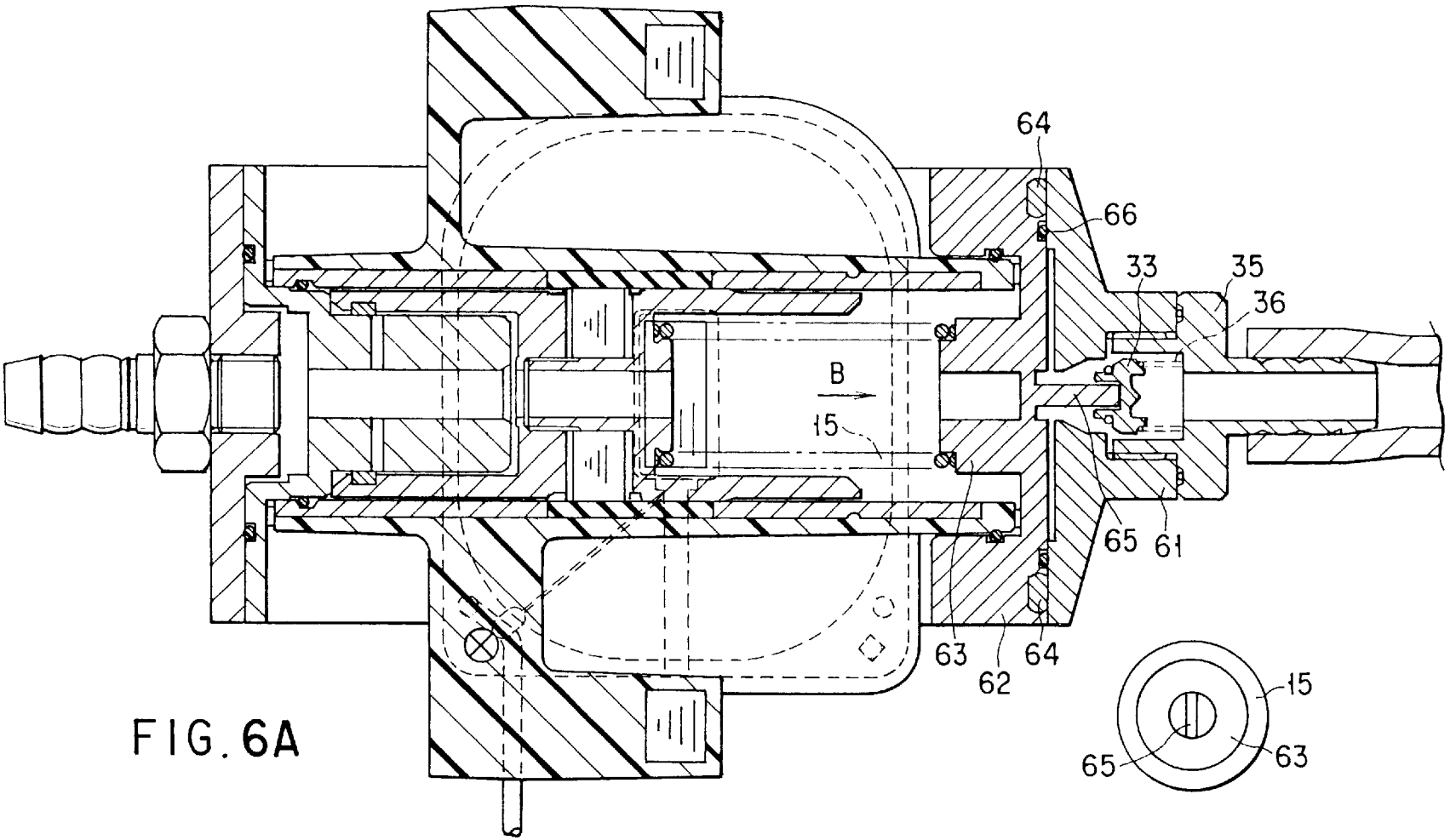
FIG. 6A is a sectional view similar to FIG. 5A, showing a modification of the electromagnetic compressor according to the third embodiment.
FIG. 6B is a view showing the relation between a spring bearing and a stopper of the electromagnetic compressor, taken in the direction of arrow B of FIG. 6A.

A modification of the third embodiment will be described with reference to FIGS. 6A and 6B. The nipple 35 is fixed to an end cap 61 that is formed of a magnetic substance such as iron, and the valve 33 is pressed outward by means of the resilient force of the spring 36. A housing 62 has a spring bearing 63 in its central portion that projects into the cylinder assembly and a stopper 65 that extends toward the valve 33, and a permanent magnet 64 is embedded in its peripheral portion. The permanent magnet 64 attracts the end cap 61 by means of its magnetic force, and forms a gastight structure based on the function of a seal ring 66.

If the pressure in the rear cylinder portion 3 extraordinarily increases so that it exceeds the force of attraction of the permanent magnet 64 that acts on the end cap 61 for any reason, in this modification, as in the aforesaid case, the end cap 61 is separated from the housing 62. In consequence, as in the third embodiment, the valve 33 is released from the force of pressure of the stopper 65 and pressed forward by means of the resilient force of the spring 36, whereupon the O-ring 34 abuts hard against a gas passage inner wall of the end cap 61. Thus, the same effect of the third embodiment can be obtained.

According to the third embodiment and its modification, therefore, the electromagnetic compressor can be used with improved safety to suck in and compress the combustible gas.

Figure 7:
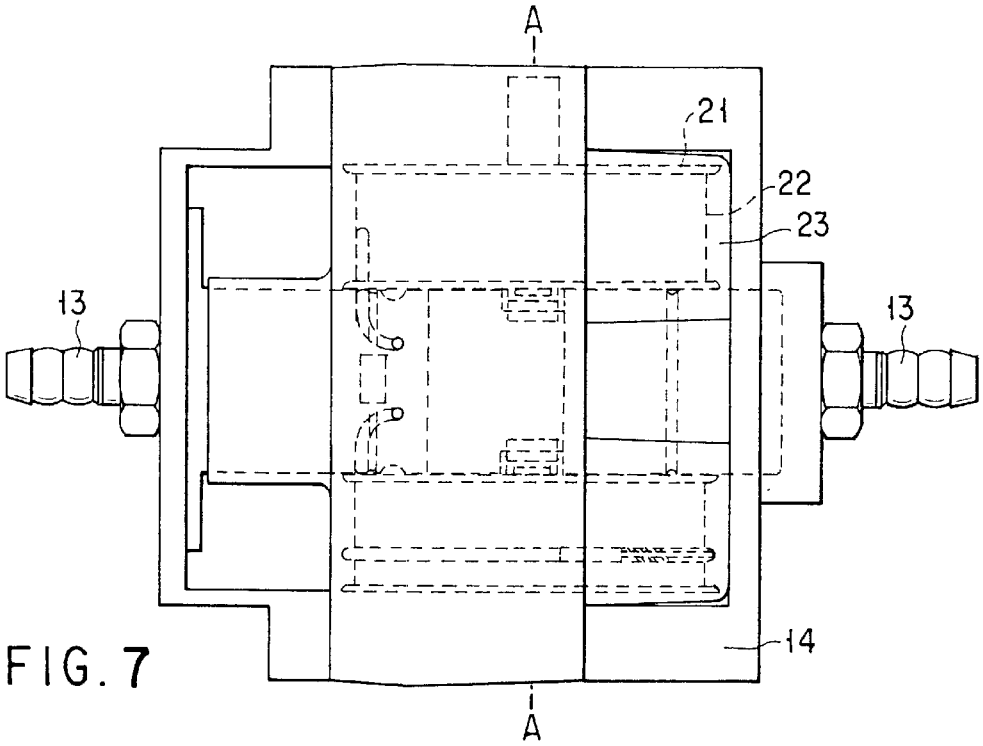
FIG. 7 is a plan view showing an external appearance of the electromagnetic compressor according to the first embodiment.
Figure 8:
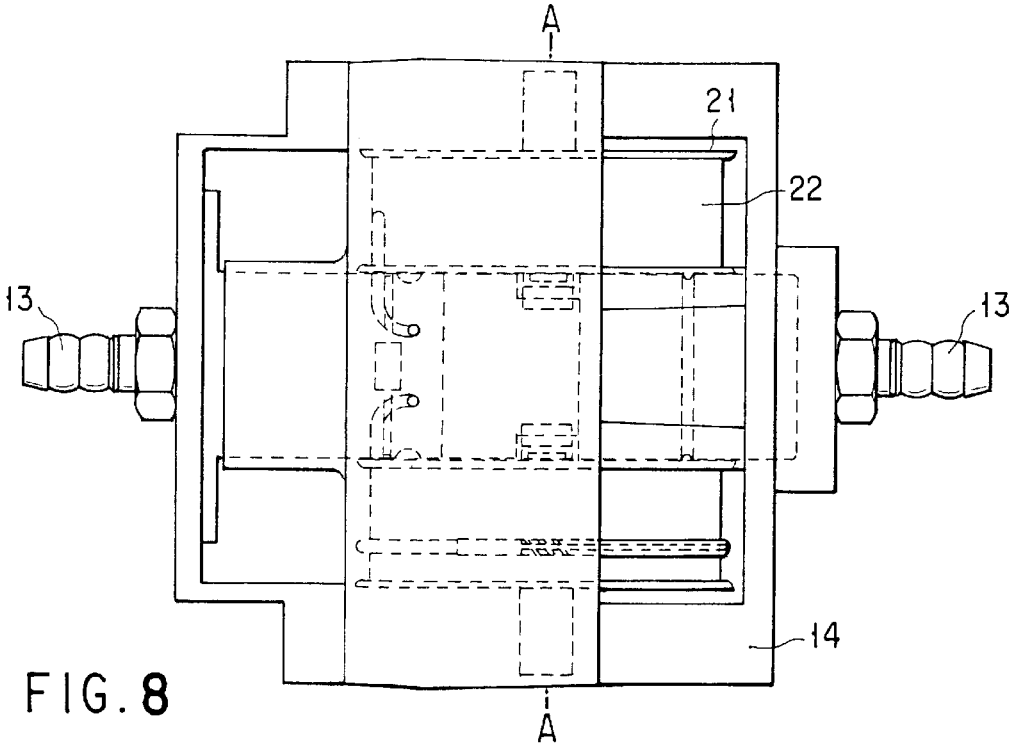
FIG. 8 is a plan view showing an external appearance of an electromagnetic compressor according to a fourth embodiment.

In each of the embodiments described above, as in the electromagnetic compressor of the first embodiment shown in FIG. 7, for example, the outside of the bobbins 21 and the coils 22 that are situated behind line II—II of the electromagnetic compressor, that is, on the suction side of the iron core 20 is coated with the resin 23. However, this outside need not be coated. Thus, the resin consumption can be saved by partially omitting the coating of the resin 23, as shown in FIG. 8. Since the coils 22 are exposed to the outside air, moreover, heat generated from the coils 22 can be quickly radiated, so that the temperature in the electromagnetic compressor can be restrained from increasing.

A fifth embodiment of the present invention will now be described with reference to FIGS. 9A to 9C.

The present invention will now be described in detail with reference to the drawings. FIG. 9A is a sectional view of the fifth embodiment of the electromagnetic compressor of the present invention, showing a sectional view taken along a plane that passes through its central axis C and extends parallel to the winding plane of a coil wound around an iron core. Further, FIGS. 9B and 9C are a left-hand side view and a right-hand side view, respectively, of FIG. 9A.

The electromagnetic compressor of the present embodiment comprises a cylinder assembly that includes, a front cylinder portion 101 in the shape of a cylinder, a spacer integrally molded from a resin and constituting a part of a housing assembly 102, and a rear cylinder portion 103 spaced from the front cylinder portion 101 by means of the spacer, which are coaxial with the central axis C and are arranged successively from the front side (left-hand side of the drawing) to the rear side (right-hand side of the drawing). The front cylinder portion 101, housing assembly 102, and rear cylinder portion 103 have therein a front piston 104, a magnetic armature 106, and a rear piston 105, which slide along their respective inner surfaces. The magnetic armature 106 is held between a rear end face 104*a* of the front piston 104 and a front end face 105*a* of the rear piston 105, and is coupled integrally to the front piston 104 and the rear piston 105. An axially extending through hole 107 is formed in the respective central portions of the front piston 104 and the rear piston 105, and an inlet valve 108 is attached to the distal end portion of this through hole.

In front of the front piston 104, a head cap 109 is opposed to the front piston 104. A discharge hole 110*b* is provided in the respective front end portions of the front cylinder portion 101 and the housing assembly 102 and in a position opposite a damper portion 110*a* in a working chamber 110. An outlet valve 111 is attached to the outside of the housing assembly 102 so as to close the discharge hole 110*b*. A fluid delivered from the outlet valve 111 is guided into a fluid discharge hole. A suitable pipe connector, such as a nipple, is coupled to this fluid discharge hole 112.

On the other hand, a return spring 114 is interposed between the rear piston 105 and an end cap 113. The head cap 109 and the end cap 113, along with the housing assembly 102, are fixed together by means of screws 115. A fluid inlet hole 116 is formed in a part of the end cap 113. When the pistons are in a suction cycle, the fluid is sucked in through the fluid inlet hole 116. A suitable pipe connector, such as a nipple, is coupled to the fluid inlet hole 116.

Figure 9A:
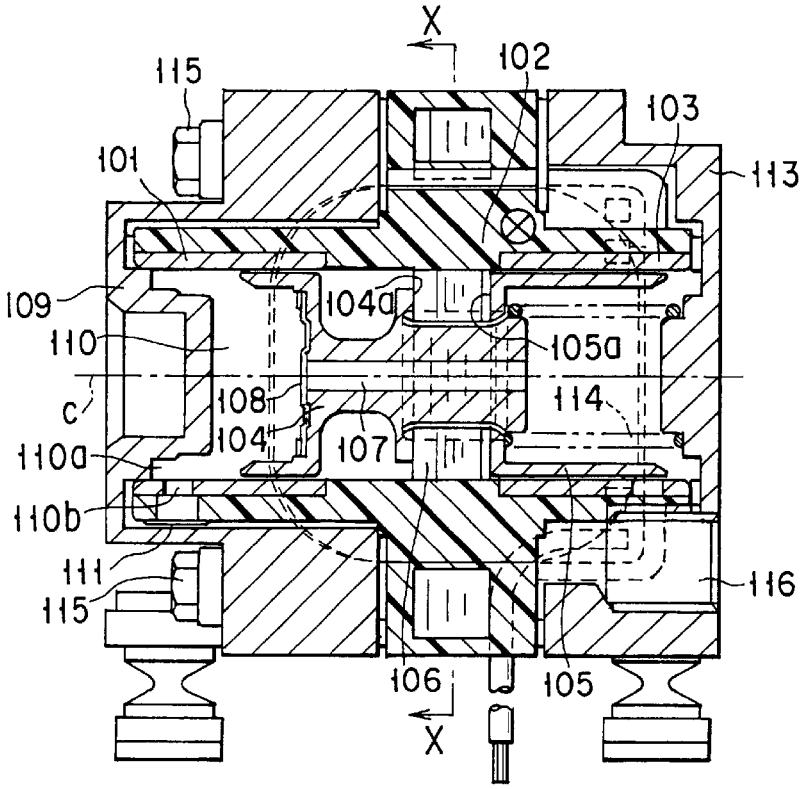
FIGS. 9A to 9C are a longitudinal sectional view and left- and right-hand side views, respectively, of an electromagnetic compressor according to a fifth embodiment of the present invention.
Figure 9B:
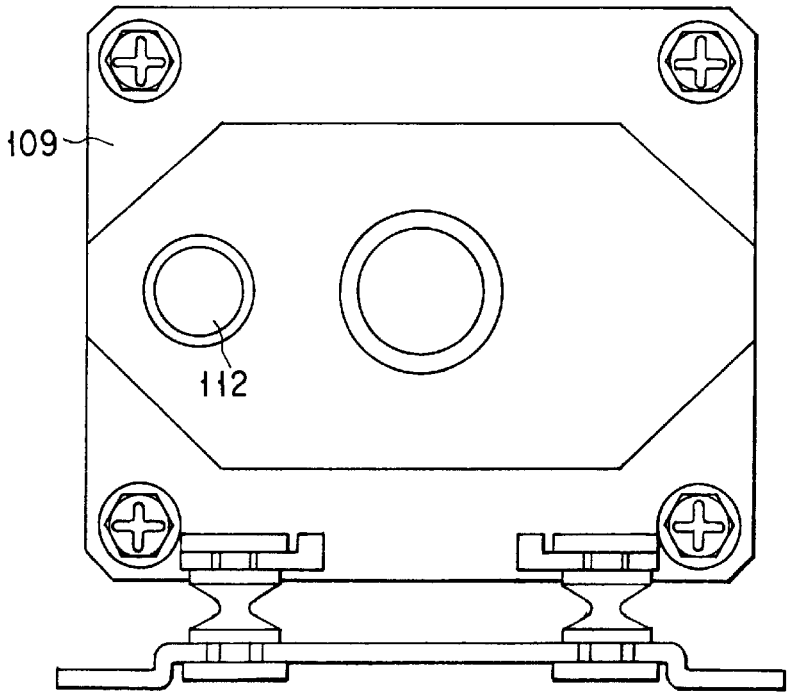
Figure 9C:
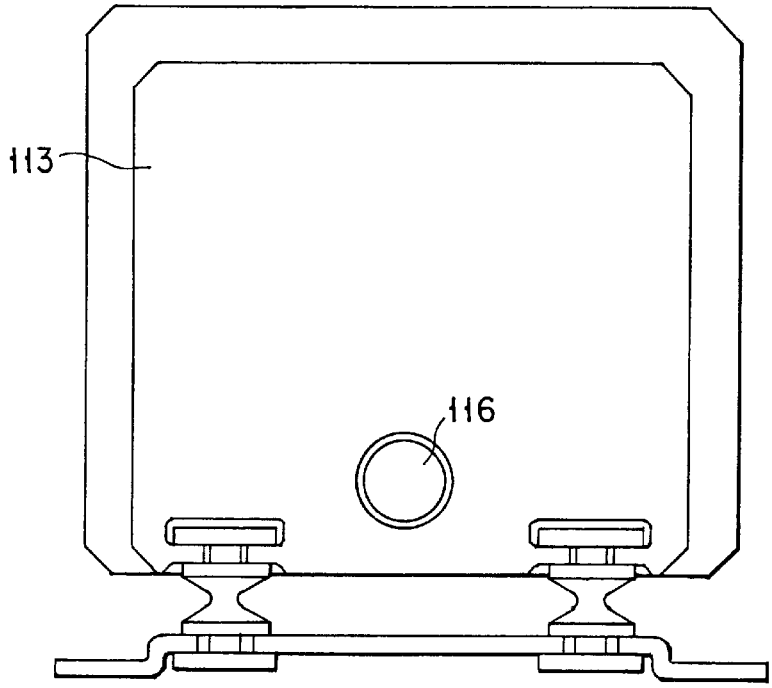
Figure 10:
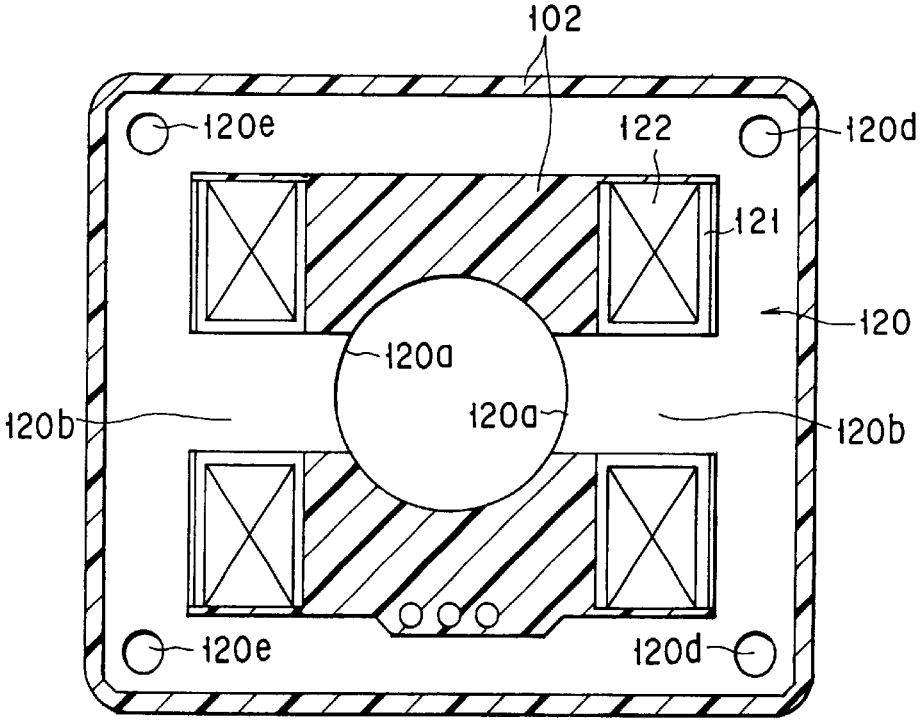
FIG. 10 is a sectional view taken along line X—X of FIG. 9A.

FIG. 10 is a view taken along line X—X of FIG. 9. In FIG. 10, the magnetic armature 106 or the rear piston 105, which is located between a pair of magnetic poles 120*a*, is not shown.

An electromagnet for electromagnetically attracting the magnetic armature 106 is located in the plane of FIG. 10. An iron core 120 of the electromagnet is located so as to coaxially surround the pistons 104 and 105 and extend along a plane perpendicular to the central axis C. Bobbins 121, each containing coils 122, are fitted individually on arm portions 120*b*, 120*b* of this iron core. When the coils 122 are energized, magnetic poles 120*a*, 120*a* are formed on the respective open ends of the arm portions 120*b*, 120*b*, individually.

As shown in FIGS. 9A to 9C and FIG. 10, a resin is molded on the inner and outer peripheries of the iron core 120 and the respective outer peripheries of the bobbins 121 and the coils 122. The iron core 120, bobbins 121, and coils 122 are formed integrally with the housing assembly 102. Further, the front and rear cylinder portion 101 and 103 are inserted and fixed in the housing assembly 102. An outer wall of the housing assembly that defines a center hole in which the front piston 104, magnetic armature 106, and rear piston 105 move back and forth is formed mainly of the aforesaid resin. Numerals 120*d* and 120*e* individually denote holes through which the screws for fixing the iron core 120 to the head cap 109 and the end cap 113 are passed.

As shown in FIGS. 9A to 9C, moreover, it can be understood that the respective outer peripheries of the cylinder portions 101 and 103 and the iron core 120 and the respective outer peripheries of the bobbins 121 and the coils 122 are entirely molded with the resin, and that an outer wall of a gas passage that is defined by the cylinder portions 101 and 103 and the through hole 107 has a sealed structure.

A manufacturing method for the configuration of the principal part of the present embodiment will now be described with reference to FIGS. 11A to 11C.

Figure 11A:
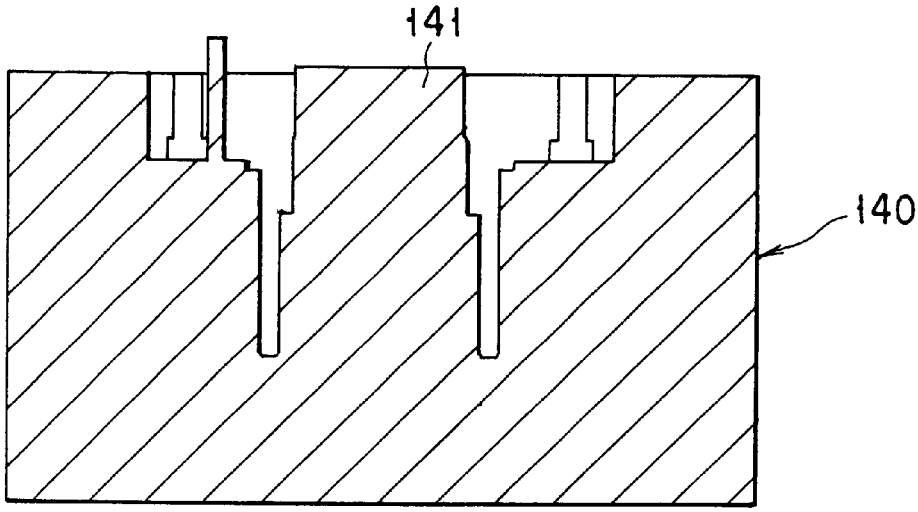
FIGS. 11A to 11C are views illustrating manufacturing processes for the electromagnetic compressor according to the fifth embodiment.
Figure 11B:
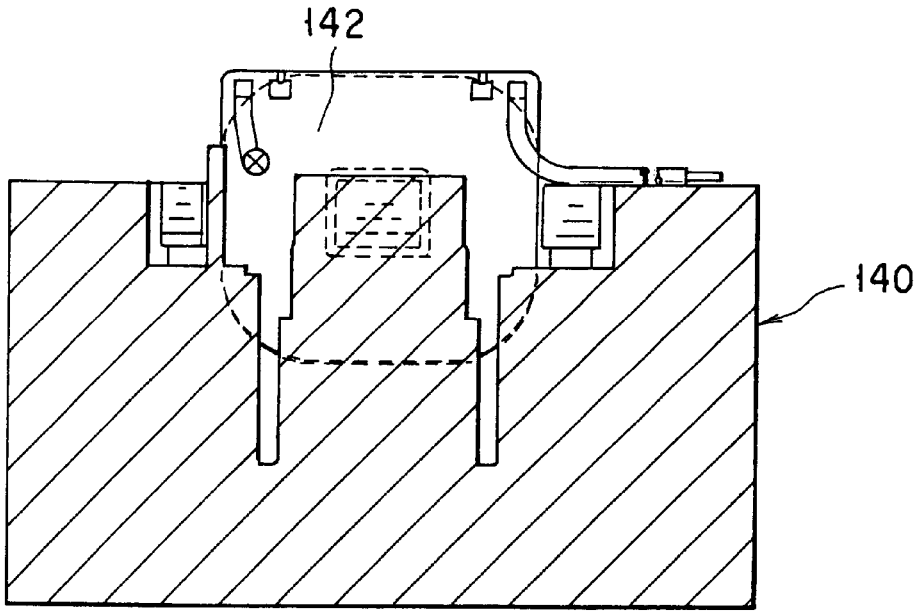

First, a cavity-side mold 140, which includes a cavity and a columnar protrusion 141 for centering in the center of the cavity, as shown in FIG. 11A, is prepared. On the other hand, an electromagnet portion 142, which integrally includes an iron core 120, bobbins 121, and coils 122, is prepared separately. As shown in FIG. 11B, moreover, the electromagnet portion 142 is set in the cavity-side mold 140. Thus, as the arm portions 120*b*, 120*b* of the electromagnet portion 142 that are formed of the opposite magnetic poles 120*a*, 120*a* are inserted into the columnar protrusion 141, the electromagnet portion 142 is set in the cavity-side mold 140.

Figure 11C:
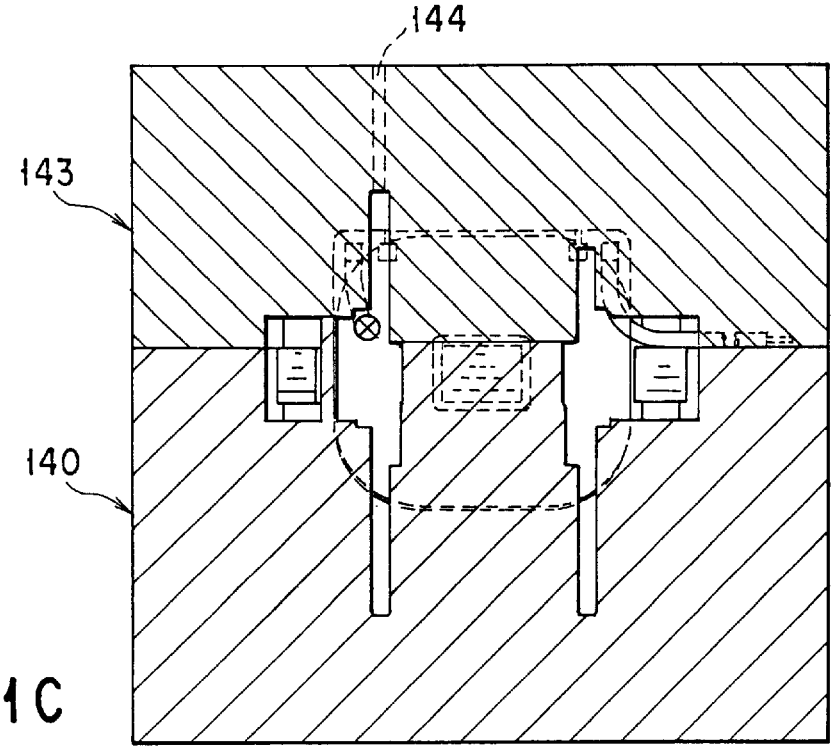

Then, a movable mold 143 is put on the cavity-side mold 140, as shown in FIG. 11C, and thermosetting resin is injected through a gate hole 144 for resin injection that is formed in the movable mold 143. If a molded piece is taken out of the molds after this resin is set, the housing assembly 102 can be obtained as a part that is held between the head cap 109 and the end cap 113 shown in FIGS. 9A and 9B or the whole part except the pistons, armature, and front and rear cylinder portions 101 and 103.

Figure 12:
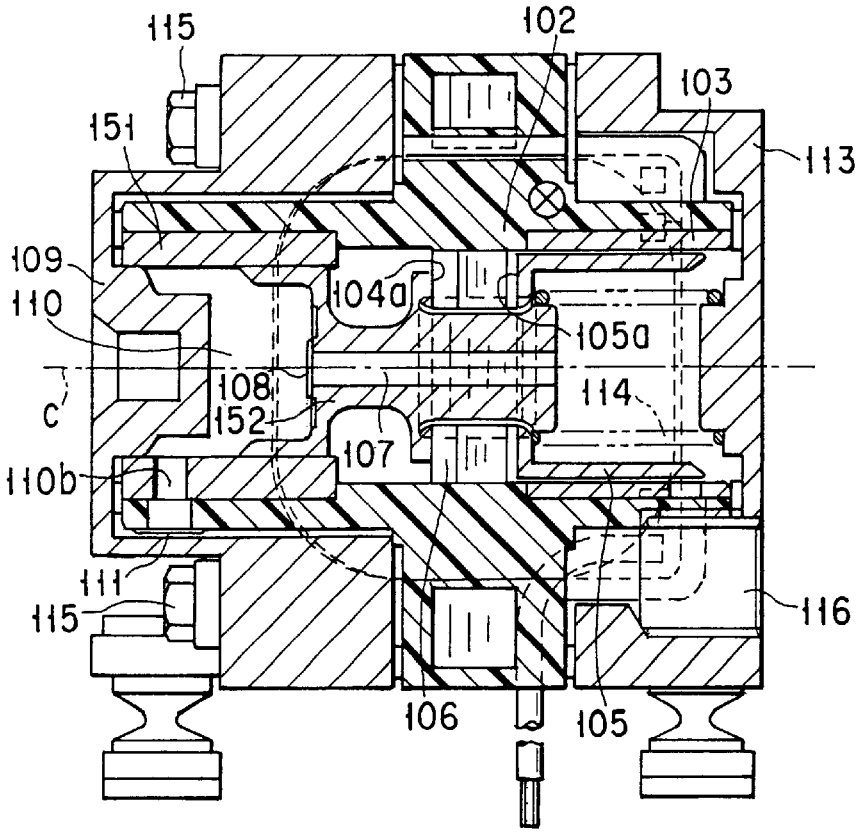
FIG. 12 is a vertical sectional view of an electromagnetic compressor according to a modification of the fifth embodiment.
Figure 13:
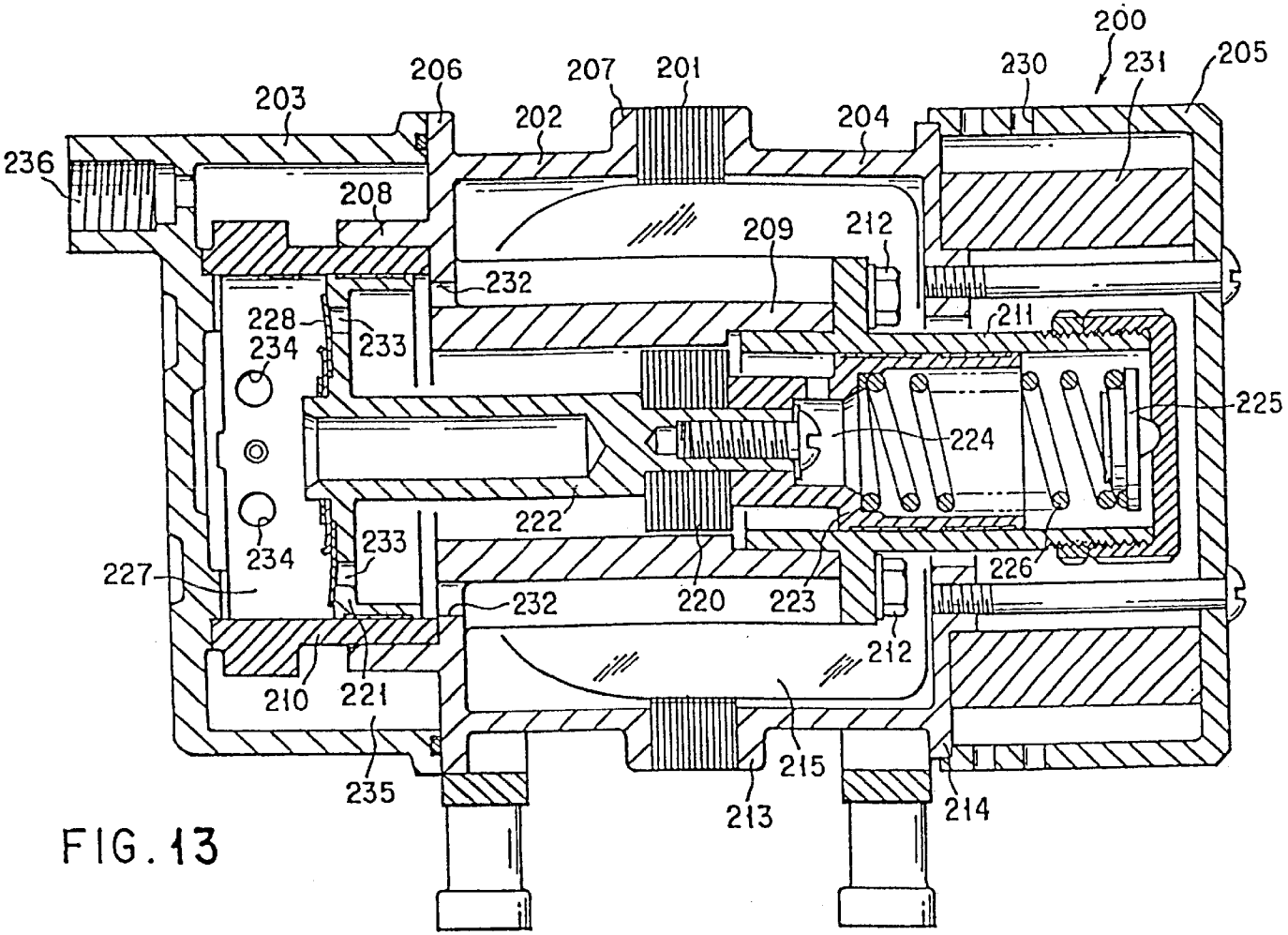
PRIOR ART FIG. 13
FIG. 13 is a sectional view of an example of a conventional apparatus.

When the housing assembly 102 is obtained in this manner, a process is carried out for fitting the front cylinder portion 101 and the rear cylinder portion 103 into the inner wall of the center hole that is coaxial with the central axis C of the housing assembly 102. As this is done, a front cylinder portion 151 that has an inside diameter that fits the outside diameter of a front piston 152 used can be fitted as the front cylinder portion 101 into housing assembly 102, as shown in FIG. 12, for example. Thus, if its outside diameter is fixed, a front cylinder portion with any desired inside diameter can be freely fitted into the housing assembly 102. In consequence, the same housing assembly 102 can be applied to a piston with any desired diameter without changing its design to match the diameter of the piston used.

After the process for fitting the front cylinder portion 101 or 151 and the rear cylinder portion 103 into the housing assembly 102 is finished in this manner, the same assembly process for the conventional case is carried out, and therefore, a description of this process is omitted.

The operation of the electromagnetic compressor of the present embodiment will now be described with reference to FIGS. 9A to 9C.

The gas, e.g., a combustible gas, enters the-rear cylinder portion 103 through the fluid inlet hole 116. If the pistons 104 and 105 move backwards (forwards) due to the force of electromagnetic attraction from the magnetic poles 120*a*, the inlet valve 108 opens, so that the gas is fed into the working chamber. When this is done, the outlet valve 111 is closed. Then, the force of electromagnetic attraction is stopped so that the pistons 104 and 105 advance (return) by means of the resilient force of the return spring 114. Thereupon, the inlet valve 108 is closed, so that the gas in the working chamber 110 is compressed. When the pressure of the gas exceeds a given level, the outlet valve 111 is opened, whereupon the gas is discharged through a fluid discharge hole 112 on the side of the head cap 109. As this is done, the forefront of front piston 104 overlaps the discharge hole 110*b* and closes the discharge hole 110*b*, so that an air damper chamber is defined between the head of the front piston 104 and the outer peripheral wall of the head cap 109. Thus, the head of the front piston 104 can be prevented from running against the outer peripheral basal part of the head cap 109 and producing a piston shock during a compression stroke.

According to the present embodiment, the gas, e.g., a combustible gas, mainly passes through the cylinder portions 101 and 103 and the through hole 107 only, and never passes through electrical parts such as the coils 122. Thus, the gas can never touch the electrical parts, so that safety can be improved. Unlike the conventional apparatus, moreover, this apparatus has no abutting portions inside and has its gas passage circumferentially entirely sealed with the resin, so that there is no possibility of the gas leaking out of the apparatus.

According to the present embodiment, furthermore, the common housing assembly can be used even if the pistons and the cylinder portions used vary in diameter.

As is evident from the above description, the foregoing electromagnetic compressor has a structure such that the internal passage from the gas inlet to outlet is hermetically sealed, so that the gas can be prevented from touching the electrical parts or from being exposed to the outside. Thus, it can be used very safely as a compressor for a combustible gas such as town gas or as a pump for fuel cells. In the case where the coils of the electromagnet are exposed at least partially to the outside air, moreover, heat from the coils can be radiated effectively, so that the temperature of the electromagnetic compressor can be prevented from being raised by the heat from the coils.

Since the damper chamber is formed in the cylinder portions, furthermore, the pistons can be effectively prevented from running against closed members such as the head cap. Accordingly, the electromagnetic compressor can be operated steadily and for a long time. Further, the head cover is formed having a thin-walled portion such that the function of the electromagnetic compressor can be stopped for security by breaking the thin-walled portion when the pressure in the electromagnetic compressor exceeds a given level. In this case, the gas can be prevented from leaking from the supply hose by means of a valve that is attached to the head cover.

Furthermore, the resin is molded around the electromagnet to form the housing assembly. If their outside diameter is fixed, therefore, cylinders with different inside diameters can be attached to housing assemblies of the same size. Thus, housing assemblies of the same size can be used to provide pistons with various external shapes, manufacturing processes for the apparatus can be simplified, and the manufacturing cost can be lowered considerably.

Since the electromagnet is stored in the molds with the resin molded on its outside, moreover, the body of the electromagnetic compressor having its internal passage from the gas inlet to outlet hermetically sealed can be manufactured with ease, and the manufacturing cost can be lowered.

Although the present invention has been described in connection with the preferred embodiments illustrated in the various drawings, it is to be understood that some other similar embodiments may be used to fulfill the same function of the present invention, or that the aforementioned embodiments may be modified or added without departing from the present invention. Thus, the present invention is not limited to any single embodiment, and should be construed as defined by the appended claims.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electromagnetic compressor capable of reciprocating a piston to suck in and compress a gas by means of the force of attraction of an electromagnet and the resilient force of a return spring, comprising:

a cylinder assembly including a front cylinder portion, a rear cylinder portion, and a center hole capable of storing said piston for reciprocation and having a working chamber defined by the piston;

an electromagnet located between said front cylinder portion and the rear cylinder portion and capable of actuating said piston;

an electrically conductive member for supplying electricity to the electromagnet; and an internal passage connecting said working chamber to the outside of the compressor, said cylinder assembly and the electromagnet having an integral structure molded from a resin in a manner such that said internal passage is hermetically sealed with respect to the electromagnet and the electrically conductive member.

2. An electromagnetic compressor according to claim 1, further comprising a spacer of an insulating material located between said front cylinder portion and the rear cylinder portion.

3. An electromagnetic compressor according to claim 1, wherein said electromagnet is designed so that at least a part of the outer periphery of a coil is exposed to the outside without being covered with said resin.

4. An electromagnetic compressor according to claim 1, wherein said cylinder assembly includes a closing member, closing one end of the center hole and defining the working chamber in conjunction with said piston, and a damper chamber located between the closing member and the piston and separable from said working chamber when said piston moves toward the closing member, the piston and the closing member being prevented from bumping into each other by means of a pressure formed in the damper chamber.

5. An electromagnetic compressor according to claim 4, wherein one of said closing member and said piston has a hole connecting said damper chamber to one of the working chamber and the internal passage, the hole being adapted to be closed when the piston nears the closing member.

6. An electromagnetic compressor according to claim 1, further comprising an end cap attached to said cylinder assembly and connected with a gas supply line, the end cap having a thin-walled portion near a region to which the supply line is connected such that the thin-walled portion can be broken to stop gas supply when the pressure of the gas supplied from the supply line exceeds a given pressure.

7. An electromagnetic compressor according to claim 6, further comprising a valve provided on said end cap and capable of cutting off the gas supplied from said gas supply line, the valve being adapted to be closed when said thin-walled portion is broken.

8. An electromagnetic compressor according to claim 1, further comprising a magnet attached to said cylinder assembly and an end cap connected with a gas supply line and capable of being coupled to the cylinder assembly with a magnetic force formed by means of the magnet, the end cap being adapted to be separated from the cylinder assembly to stop gas supply when the pressure of the gas supplied from the supply line exceeds a given pressure.

9. An electromagnetic compressor according to claim 8, further comprising a valve provided on said end cap and capable of cutting off the gas supplied from said gas supply line, the valve being adapted to be closed when the end cap is separated from the cylinder assembly.

10. An electromagnetic compressor capable of reciprocating a piston to suck in and compress a gas by means of the force of attraction of an electromagnet and the resilient force of a return spring, comprising:

a housing assembly having a center hole in which said piston is located and a resin layer molded around an electromagnet forming a pair of magnetic poles on the diametrically opposite sides of the piston; and a cylinder portion stored in said center hole, storing said piston for reciprocation, and having a working chamber defined by means of the piston;

the inside diameter of said cylinder portion and the outside diameter of the piston sliding in the cylinder being selectable.

* * * * *